US011173386B2

(12) United States Patent
Nevgi et al.

(10) Patent No.: US 11,173,386 B2
(45) Date of Patent: Nov. 16, 2021

(54) THREE-DIMENSIONAL LOGIC PUZZLE

(71) Applicant: Trimiti Moebius Design Pty Ltd, Mount Waverley (AU)

(72) Inventors: Umesh Vinayak Nevgi, Mount Waverley (AU); Hersh Umesh Nevgi, Mount Waverley (AU)

(73) Assignee: TRIMITI MOEBIUS DESIGN PTY LTD, Mount Waverley (AU)

( * ) Notice: Subject to any disclaimer, the term of this patent is extended or adjusted under 35 U.S.C. 154(b) by 0 days.

(21) Appl. No.: 16/317,457

(22) PCT Filed: Jul. 13, 2017

(86) PCT No.: PCT/AU2017/050721
§ 371 (c)(1),
(2) Date: Jan. 11, 2019

(87) PCT Pub. No.: WO2018/009975
PCT Pub. Date: Jan. 18, 2018

(65) Prior Publication Data

US 2019/0299088 A1 Oct. 3, 2019

Related U.S. Application Data

(63) Continuation of application No. PCT/AU2017/050721, filed on Jul. 13, 2017.

(30) Foreign Application Priority Data

Jul. 15, 2016 (AU) ..... 2016902785

(51) Int. Cl.
*A63F 9/12* (2006.01)
*A63F 9/06* (2006.01)
*A63H 33/06* (2006.01)

(52) U.S. Cl.
CPC ..... *A63F 9/1208* (2013.01); *A63F 9/0669* (2013.01); *A63F 9/12* (2013.01);
(Continued)

(58) Field of Classification Search
CPC .. A63F 9/12; A63F 9/1208; A63F 2009/1216; A63F 2009/0697;
(Continued)

(56) References Cited

U.S. PATENT DOCUMENTS 669,445 A * 3/1901 Morey, Jr. ..... A63F 9/10
273/157 R
1,472,536 A * 10/1923 Thomson ..... A63H 33/108
434/403

(Continued)

FOREIGN PATENT DOCUMENTS

GB 2423727 A 9/2006
JP S53147994 U 11/1978

(Continued)

OTHER PUBLICATIONS

"Wooden Intelligence Game 3D Wood IQ Puzzle Brain Teaser Magic Tetris Cube 54 pc", Retrieved on Oct. 26, 2019] << https://www.amazon.com/wooden-intelligence-puzzle-teaser-tetris/dp/b011fxog8m/ref=sr_1_30/176-4660663-4922211?ie=UTF8&qid=1441240587&sr=8-30&keywords=simple%2btetris>>, 3 pages (Year: 2015).*

(Continued)

*Primary Examiner* — Steven B Wong
(74) *Attorney, Agent, or Firm* — Alleman Hall Creasman & Tuttle LLP

(57) ABSTRACT

A three-dimensional logic puzzle is provided. The puzzle includes a plurality of identically shaped puzzle components of an irregular form. Each puzzle component is configured to engage with another identically shaped puzzle component (Continued)

via projections and recesses formed on the sides of the puzzle components. The plurality of puzzle components are interengagably assembled into the form of a predetermined three-dimensional geometric shape.

20 Claims, 21 Drawing Sheets

(52) U.S. Cl.
CPC .... *A63H 33/062* (2013.01); *A63F 2009/0697* (2013.01); *A63F 2009/1216* (2013.01)

(58) Field of Classification Search
CPC ... A63F 9/0669; A63B 9/0669; A63H 33/062; A63H 33/088; A63H 33/086; A63H 33/08
USPC ..... 273/157 R, 156; D21/479
See application file for complete search history.

(56) References Cited

U.S. PATENT DOCUMENTS 3,005,282 A * 10/1961 Godtfred ..... A63H 33/086 446/128
3,546,792 A * 12/1970 Raymond ..... A63H 33/088 434/96
3,638,949 A * 2/1972 Thompson ..... A63F 9/12 273/157 R
3,672,681 A * 6/1972 Wolf ..... A63F 9/12 273/157 R
3,689,075 A * 9/1972 Adelsohn ..... A63F 9/12 273/157 R
3,854,237 A * 12/1974 Loth ..... A63H 33/108 446/122
4,077,154 A 3/1978 Muller
D279,915 S * 7/1985 Arnau Pibet ..... D21/500
4,568,082 A * 2/1986 Musolino ..... A63F 3/02 273/157 R
4,624,647 A 11/1986 Munnix
4,678,192 A * 7/1987 Campbell ..... A63F 9/12 273/157 R
4,744,780 A * 5/1988 Volpe ..... A63H 33/086 403/300
4,784,392 A * 11/1988 Johnson ..... A63F 9/12 273/160
4,844,466 A * 7/1989 Johnson ..... A63F 9/12 273/157 R
5,000,713 A * 3/1991 Cheng ..... A63H 33/06 273/160
5,098,328 A * 3/1992 Beerens ..... A63H 33/086 446/125
D336,666 S * 6/1993 Knudsen ..... D21/501
5,538,452 A * 7/1996 Kurani ..... A63F 9/088 446/102
5,823,533 A * 10/1998 Edwards ..... A63F 9/12 273/160
5,868,388 A * 2/1999 Wood ..... A63F 3/0023 273/157 R
D411,591 S * 6/1999 Laserna Fernandez ..... D21/500
D413,636 S * 9/1999 Laserna Fernandez ..... D21/499
D422,036 S * 3/2000 Laserna Fernandez ..... D21/499
6,196,544 B1 * 3/2001 Rachofsky ..... A63F 9/12 273/157 R
6,237,914 B1 * 5/2001 Saltanov ..... A63F 9/12 273/156
6,241,248 B1 * 6/2001 Winter ..... A63F 9/12 273/153 S
6,679,780 B1 1/2004 Shih
6,790,118 B2 * 9/2004 Ahn ..... A63H 33/04 434/208
8,771,032 B2 * 7/2014 Chang ..... A63H 33/086 446/124
8,888,552 B2 * 11/2014 Wizenberg ..... A63H 33/086 446/102
D727,438 S * 4/2015 Stegmann ..... D21/480
D760,324 S * 6/2016 Akimoto ..... D21/499
D806,179 S * 12/2017 Simonds ..... D21/499
D806,181 S * 12/2017 Johannsen ..... D21/500
10,004,998 B2 * 6/2018 Shih ..... A63H 33/08
D832,935 S * 11/2018 Wakim ..... D21/499
D832,936 S * 11/2018 Semling ..... D21/499
D835,212 S * 12/2018 Semling ..... D21/499
D841,742 S * 2/2019 Semling ..... D21/499
2005/0110212 A1 * 5/2005 Shih ..... A63F 9/1204 273/153 R
2008/0160875 A1 * 7/2008 Leicht ..... A63F 9/12 446/124
2012/0032393 A1 * 2/2012 Leicht ..... A63H 33/106 273/156
2013/0072082 A1 3/2013 Wizenberg et al.
2017/0209802 A1 * 7/2017 Sisamos ..... A63H 33/088
2017/0232333 A1 * 8/2017 Meyers ..... A63F 9/0602 273/157 R

FOREIGN PATENT DOCUMENTS

TW 201247292 A 12/2012
WO 9322018 A1 11/1993
WO 2018009975 A1 1/2018

OTHER PUBLICATIONS

Wooden Intelligence Game 3D Wood IQ Puzzle Brain Teaser Magic Tetris Cube 54 pc, Amazon, [Retrieved from internet on Sep. 22, 2017] URL:hhttps://www.amazon.com/Wooden-Intelligence-Puzzle-TeaserTetris/dp/B011FXOG8M/ref=sr_1_30/176-4660663-4922211?ie=UTF8&qid=1441240587&sr=8-30&keywords=simple%2Btetris, published on Jul. 12, 2015, 3 pages.

* cited by examiner

THREE-DIMENSIONAL LOGIC PUZZLE

FIELD OF THE INVENTION

The present invention relates to a logic puzzle. More particularly, the invention relates to a three-dimensional (3D) jigsaw puzzle comprising a plurality of identically shaped puzzle components.

BACKGROUND OF THE INVENTION

Puzzles of all types have been popular for generations and can provide hours of entertainment to adults and children alike, while providing an intellectual challenge and stimulation. Three-dimensional logic and jigsaw puzzles particularly test a user's spatial skills and provide a unique alternative to previously available puzzles.

Examples of previous three-dimensional jigsaw puzzles include the Soma Cube, Bedlam Cube, Polycube, Conway Puzzle, Slothouber-Graatsma Puzzle, Diabolical Cube. Previous three-dimensional puzzles have been complicated to manufacture due to the large number of different parts required to be made and can thus be expensive to produce as they are typically formed of wood/timber. Furthermore, previous three-dimensional puzzles have lacked interlocking engagement between the puzzle components, making them unwieldy for the purposes of handling and vulnerable to coming apart easily, which is particularly a problem for larger puzzles.

Examples of the invention seek to solve, or at least ameliorate, one or more disadvantages of previous three-dimensional puzzles.

SUMMARY OF THE INVENTION

According to one aspect of the present invention, there is provided a three-dimensional logic puzzle, comprising a plurality of identically shaped puzzle components of an irregular form, the puzzle components being configured for interengaged assembly into the form of a predetermined three-dimensional geometric shape.

According to a preferred embodiment of the present invention, the puzzle components are each formed of a plurality of individual elements. The individual elements may be similar to one another. The individual elements may be cuboid. Alternatively, the individual elements may be formed of three planar bodies sharing a common centre and arranged perpendicular to each other.

The puzzle components may be formed from four individual elements arranged in a generally "S" shape. Alternatively, the puzzle components are formed from three individual elements arranged in a generally "L" shape.

In some embodiments, the geometric shape is a cube and the length of sides of the cube is equal to the size of each element multiplied by the number of elements in each puzzle component.

In a preferred form, the puzzle components are configured for interlocking engagement with each other. In such embodiments, each puzzle component may be formed with at least one projection and at least one correspondingly shaped recess, the projection configured for engagement with a corresponding recess on an adjacent puzzle component.

Preferably, the puzzle components comprise two projections and two recesses on opposing major sides of each puzzle components, wherein the arrangement of projections and recesses on each side is opposite to the opposing side.

The recesses may be disposed on minor sides of each puzzle component. The projections and/or the recesses may be formed with snap-fit interlocking features. The at least one projection can be generally cylindrical. Alternatively, the at least one projection can have a cross section in the form of a parallelogram.

In some embodiments the geometric shape is a regular geometric shape. Preferably, the shape is selected from a group including a parallelepiped, a cube, a pyramid, a sphere, a prism, a cone, a cylinder and a torus.

According to another aspect of the present invention, there is provided a puzzle component for use in a puzzle of the above described type, the puzzle component being of irregular form. The puzzle component may be constructed of a plurality of like individual elements.

According to another aspect of the present invention, there is provided a method of assembling a three-dimensional logic puzzle, the puzzle comprising a plurality of identically shaped puzzle components of an irregular form which are configured for interengaged assembly into the form of a three-dimensional geometric shape, including the steps of reorientating each puzzle component by rotating it about its axes, and bringing the puzzle components into interengagement with other adjacent components to form the three-dimensional geometric shape.

BRIEF DESCRIPTION OF THE DRAWINGS

Preferred embodiments of the invention will be further described, by way of non-limiting example only, with reference to the accompanying drawings in which.

DETAILED DESCRIPTION

Figure 1:
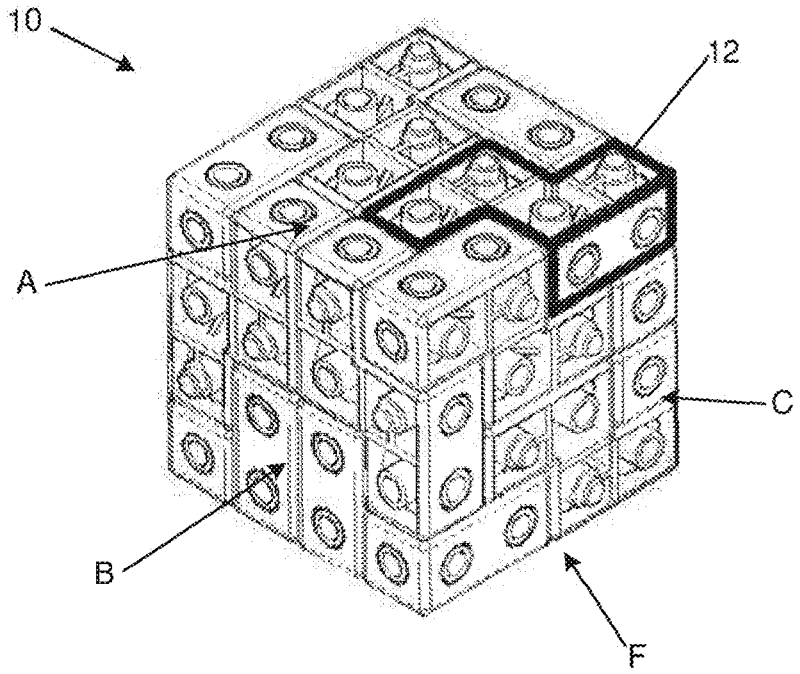
FIGS. 1 to 4 are 3D orthographic views of different sides of a logic puzzle of one embodiment of the invention.
Figure 2:
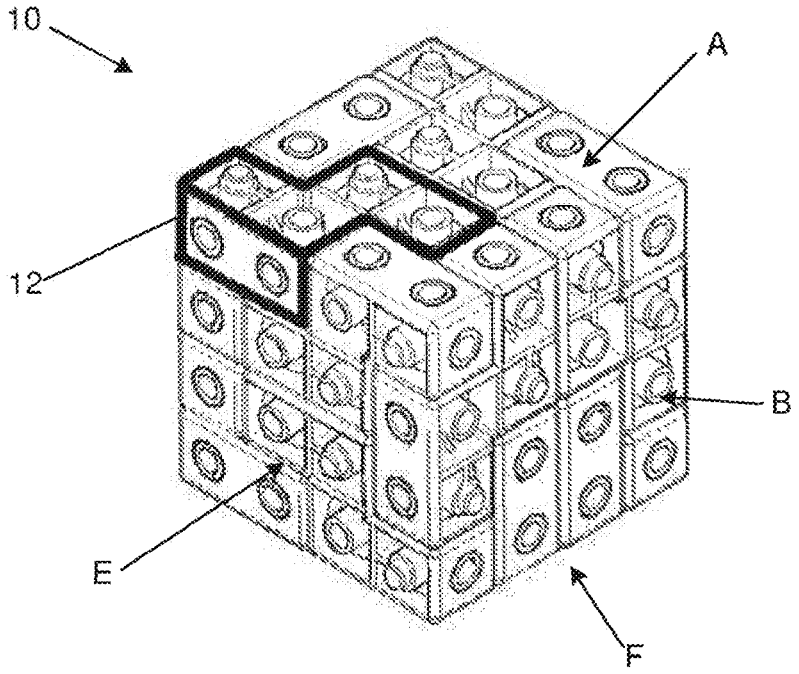
Figure 3:
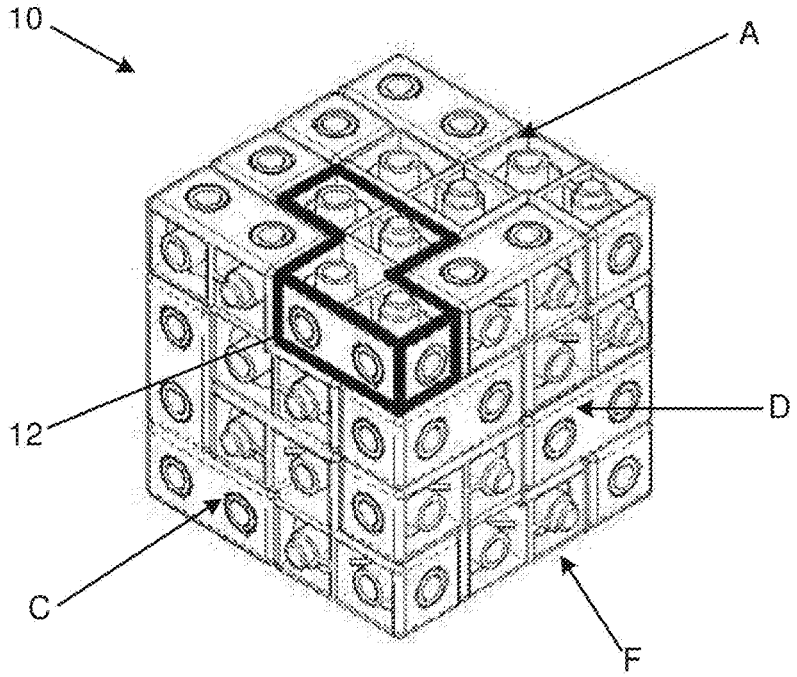
Figure 4:
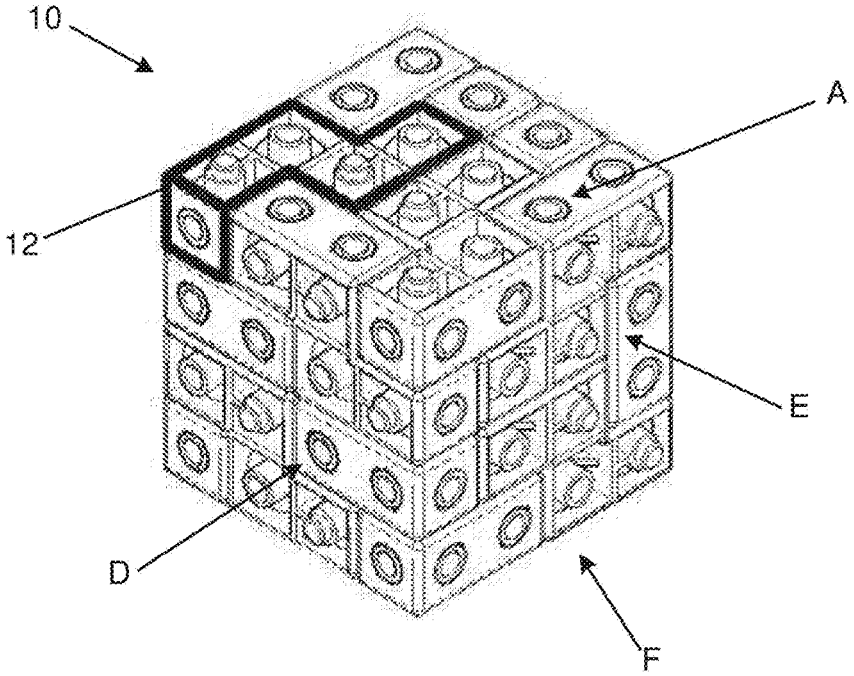
Figure 5:
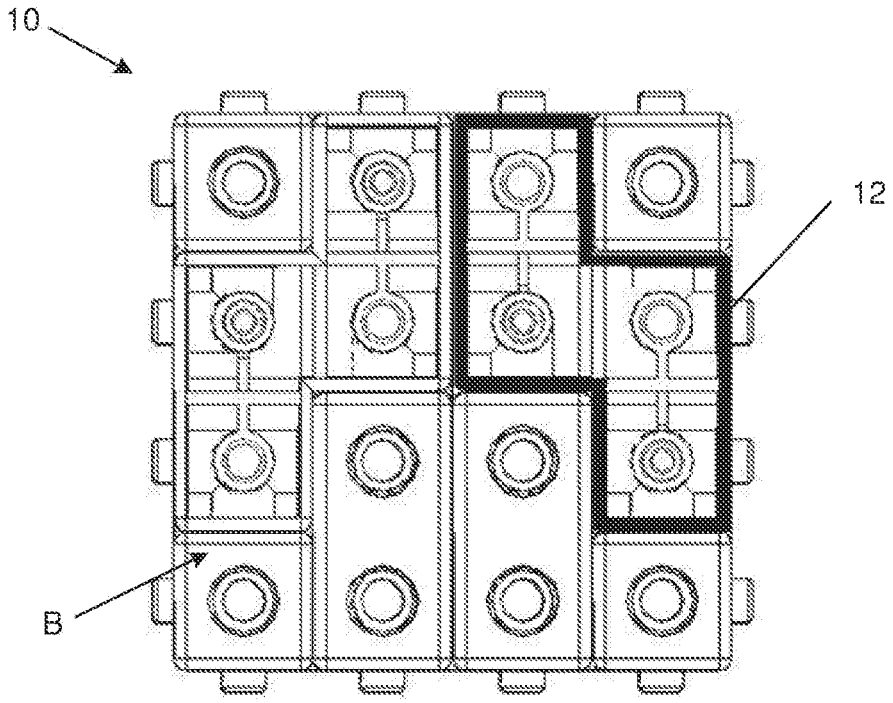
FIG. 5 is a side view of surface B of the logic puzzle.
Figure 6:
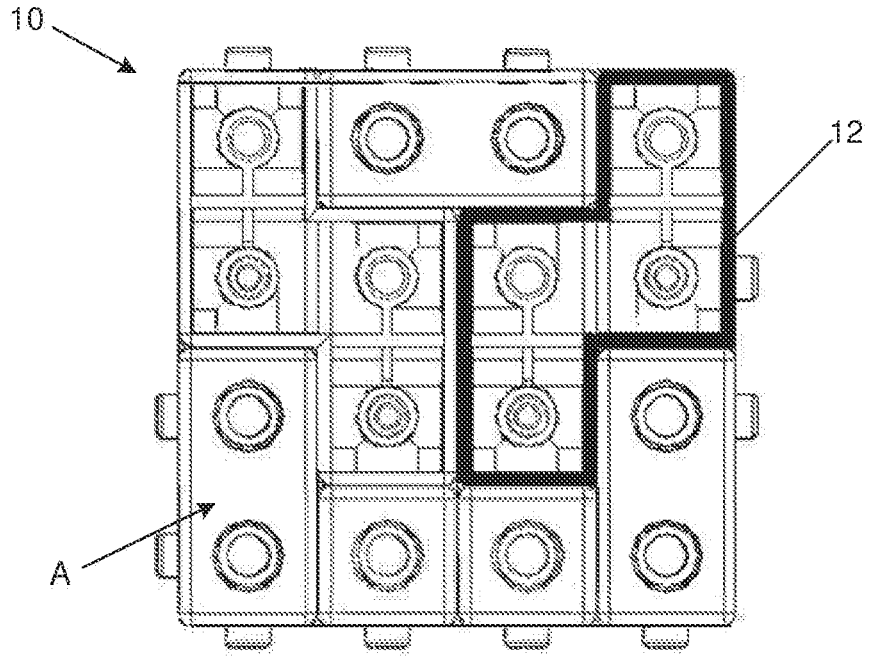
FIG. 6 is a side view of surface A of the logic puzzle.

With reference to FIG. 1, there is shown a logic puzzle 10. The logic puzzle 10 is in the form of a three-dimensional jigsaw puzzle.

The puzzle 10 comprises a plurality of identically shaped puzzle components 12 (one of which is shown highlighted by a thicker outline) of an irregular form, as described further below. The puzzle components 12 are configured for interengaged assembly into the form of a predetermined three-dimensional geometric shape. In this regard, the shape and configuration of the puzzle components 12 are such that the puzzle components 12 can be arranged in at least one sequence to form a substantially complete three-dimensional shape with generally continuous sides which are made up of closely nested and interengaged puzzle components 12 that closely fit together, which may, but not necessarily, be interlocked together to retain the final three-dimensional geometric shape.

The puzzle components 12 are identically shaped and sized, though may be provided in different colours, have different surface finishes or be made from different materials, to visually engage a user.

FIGS. 1 to 6 illustrate different views of the puzzle 10 to show the different faces A, B, C, D and E (face F is indicated but not seen in the drawings) and the arrangement of the puzzle components 12 (one of which is shown highlighted by a thicker outline) used to form the puzzle 10. It can be seen that one or more of the puzzle components 12 are oriented in a different manner, by rotating about any one of its axes, to reorientate the puzzle component 12 and interengage it with other adjacent components 12. In use, a user can arrange the puzzle 10 through trial and error to arrive at the desired predetermined form.

In the embodiment illustrated in FIGS. 1 to 6, the geometric shape or final predetermined form is a cube. Other forms that the three-dimensional shape may take are discussed below. In this embodiment, the length of sides of the cube is equal to the size of each element 14 of the puzzle component 12 multiplied by the number of elements 14 in each puzzle component 12. In other embodiments, a cube of this size can be formed by puzzle components 12 formed of eight elements 14. In such an embodiment, only eight puzzle components will be required, compared with 16 for the illustrated embodiment.

In the illustrated example, each puzzle component 12 is formed of four individual elements that are generally cuboid, resulting in sides of the puzzle 10 being of a length equal to four individual elements 14. In view of this construction, puzzle 10 will be referred to as a 4× puzzle. Each element 14 is a basic-element cubelet of unit size. Also, the cube is formed of sixteen puzzle components 12 and an equivalent to sixty-four elements 14.

FIGS. 7 to 10 illustrate in more detail a puzzle component 12 for use with the embodiment shown in FIG. 1. The puzzle components 12 are formed from four individual elements 14 of identical size and shape and which are arranged in a generally "S" shape. In this regard, two elements 14 are arranged along a common longitudinal axis which is offset from a common longitudinal axis of the other two elements.

Although the individual elements 14 are illustrated as being cuboid, it will be appreciated that they may take other forms, such as generally spherical or that shown in FIGS. 11 to 13, for example, which will be described in further detail below. Also, the individual elements may not be entirely cuboid so that there is some play in the final three-dimensional geometric shape.

So as to provide a challenging puzzle, the puzzle components 12 are of irregular form so that the solution to the puzzle is not obvious and cannot be obtained by simply stacking the puzzle components 12 together. The term "irregular form" is intended to mean that the puzzle components are not even or balanced.

Figure 11:
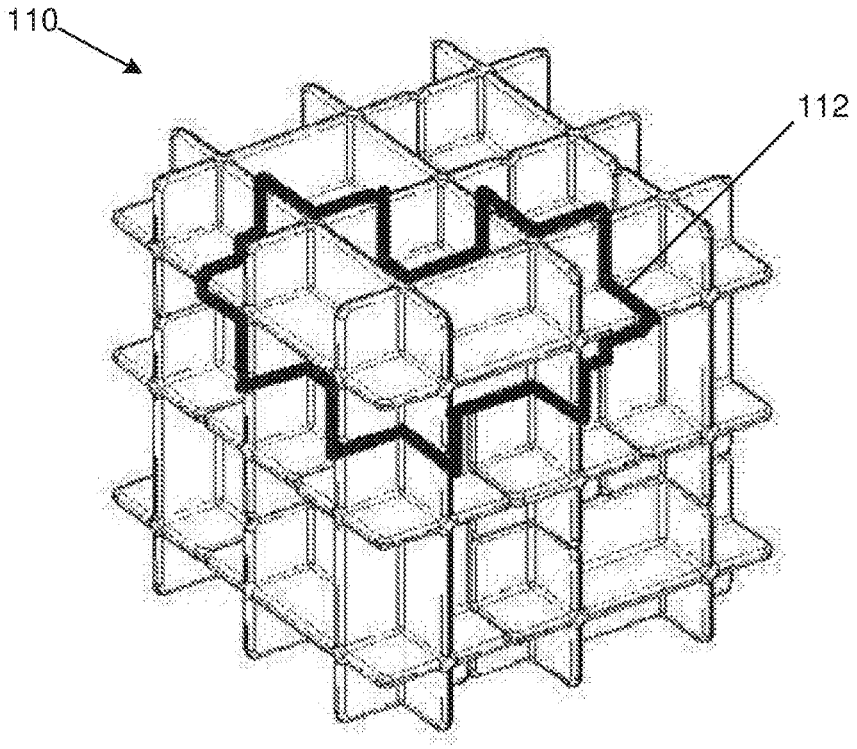
FIG. 11 is a 3D orthographic view of a logic puzzle of another embodiment of the invention.
Figure 12:
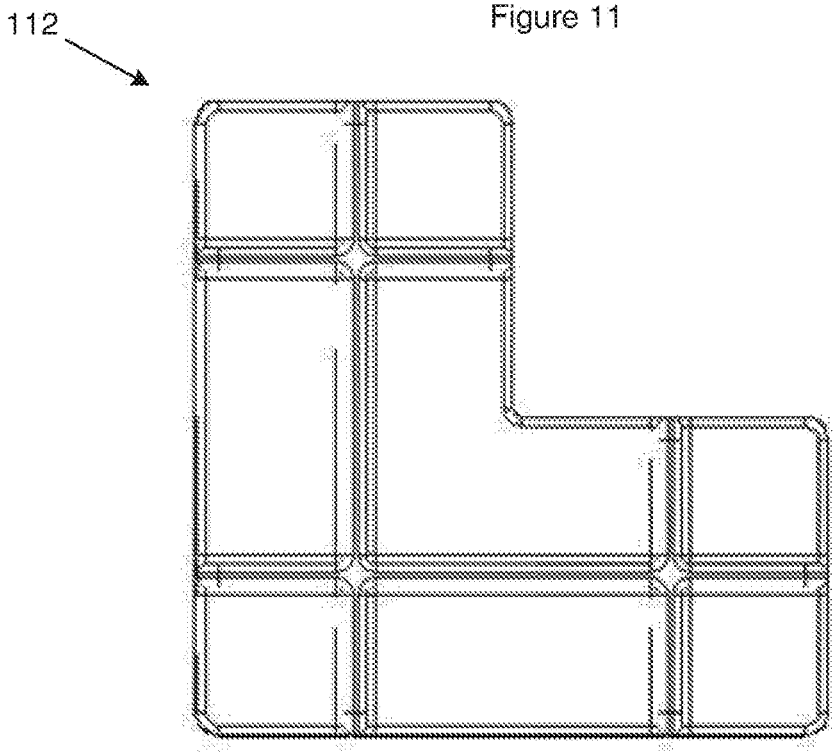
FIG. 12 is a side view of a puzzle component for use in the logic puzzle of FIG. 11.
Figure 13:
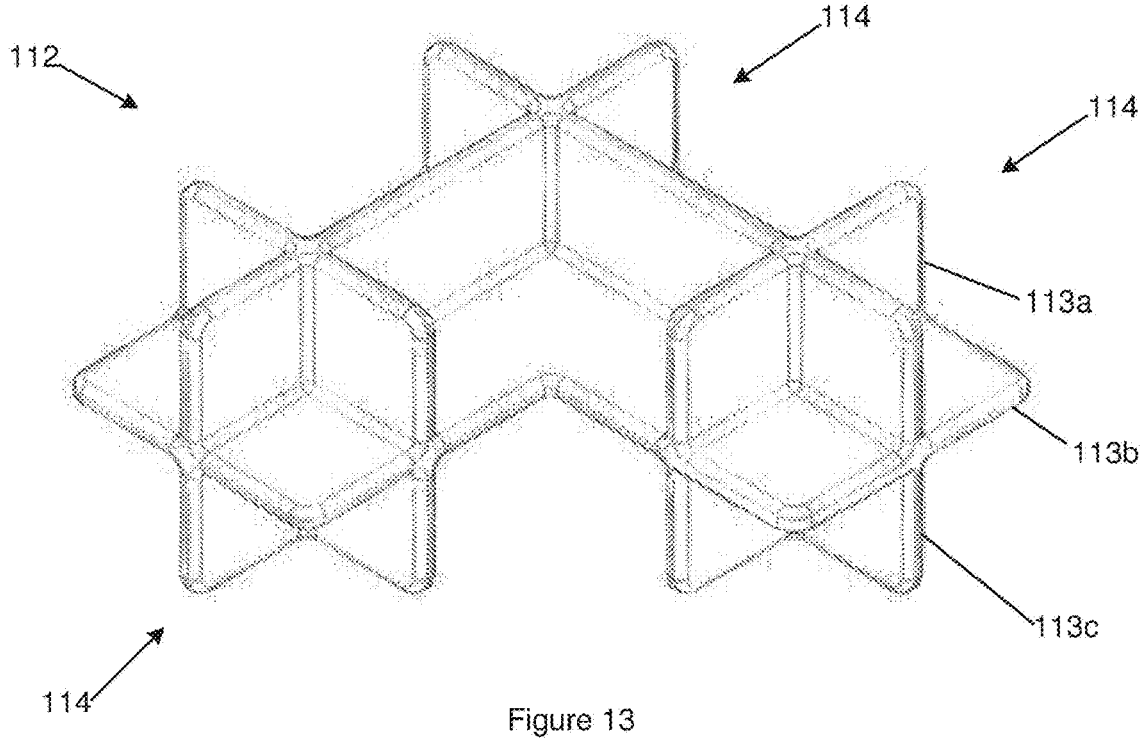
FIG. 13 is a 3D orthographic view of the puzzle component of FIG. 12.

FIGS. 11 and 13 illustrate another puzzle 110 according to an alternative embodiment of the invention. In this embodiment, puzzle component 112 (shown highlighted by a thicker outline in FIG. 11) is not cuboid in shape and, instead, the individual elements 114 are formed of three planar bodies 113*a*, 113*b*, 113*c* of unit length and having a common centre and arranged to be mutually orthogonal. In elevation view, two of the planar bodies will be shown generally cross-wise.

FIG. 11 also illustrates that the puzzle component 112 is formed of three integrally formed elements. Based on this construction, puzzle 112 will be referred to as a 3× puzzle.

The puzzle components 112 are formed from three individual elements arranged in a generally "L" shape. Again, because the puzzle components 112 are of irregular form the solution to puzzle 110 is not obvious and cannot be obtained by simply stacking the puzzle components 112 together. In use, a user can arrange the puzzle 110 through trial and error to arrive at the desired predetermined form.

Although the illustrated embodiments relate to a puzzle component formed of three or four elements, it will be appreciated that other numbers of elements over 4, such as 5, 6, 7, 8, 9 or 10 for example, will also be possible. In such embodiments, the final form of the puzzle will include many more elements and may be larger in size, though to compensate this, the size of the elements may be reduced. For example, a 5× puzzle may be formed of 125 individual elements, a 6× puzzle may be formed of 216 elements and so on.

Furthermore, the puzzle components may be arranged in shapes other than the generally "L" or "S" shapes illustrated. In this regard, the puzzle components may take a "T", "C", "E" or cross or any other shape. Also, shapes having varying proportions or arm lengths may also be possible.

In some embodiments, the puzzle components 12 are simply retained together by their interengaging nature. However, the puzzle components 12 may also be configured for interlocking engagement with each other. FIGS. 1 to 10 illustrate one method of achieving this interlocking engagement in connection with puzzle 10.

To provide a method of interlocking, each puzzle component is formed with at least one projection, either snap-fit as described below or otherwise, or a male plug and at least one correspondingly shaped recess, either snap-fit as described below or otherwise, or female socket, the projections/plugs being configured for engagement with corresponding recesses/sockets on an adjacent puzzle component. As indicated above, the puzzle 10 may not be provided with any interlocking feature whatsoever.

Figure 7:
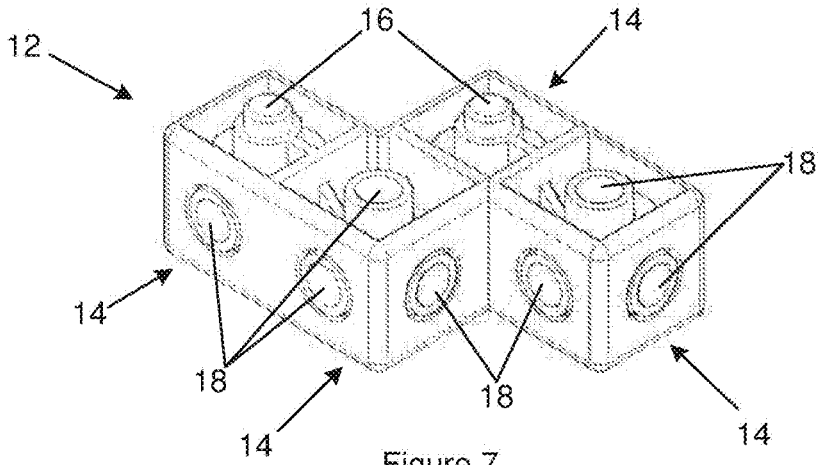
FIG. 7 is a 3D orthographic view of a puzzle component for use in the puzzle of FIGS. 1 to 4.
Figure 8:
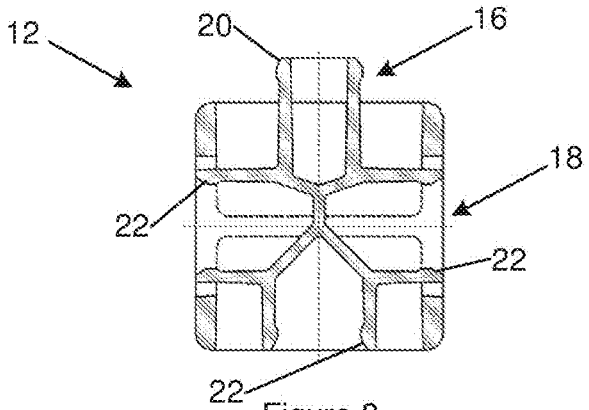
FIG. 8 is a sectional view of the puzzle component of FIG. 7.
Figure 9:
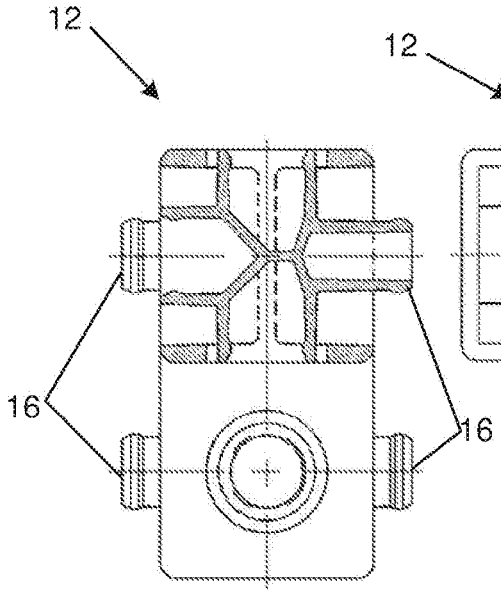
FIG. 9 is another sectional view of the puzzle component of FIG. 7.
Figure 10:
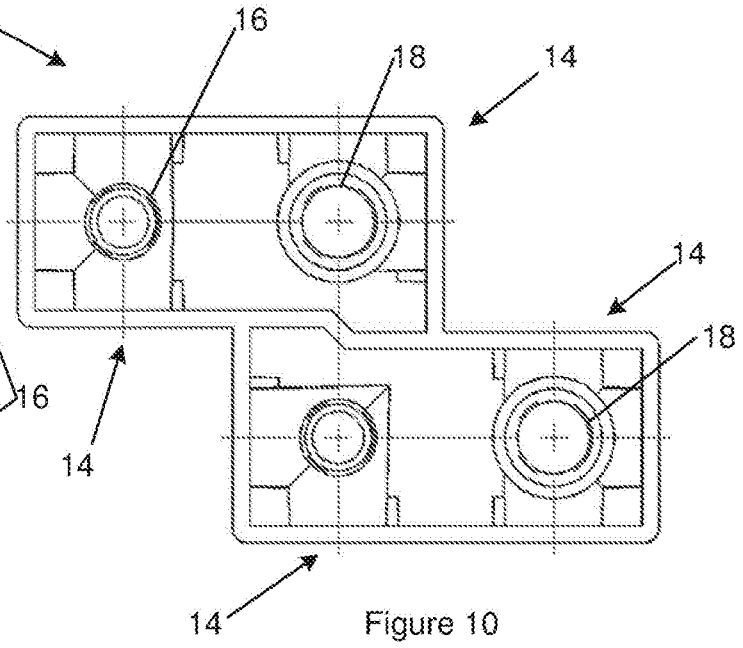
FIG. 10 is a side view of the puzzle component of FIG. 7.

As illustrated in FIGS. 7 to 10, puzzle component 12 is formed with two projections 16 and two recesses 18 on opposing major sides thereof. Sides of puzzle component 12 comprise substantially planar faces. As shown in FIGS. 7 and 8, recesses 18 are defined by a wall that extends from an interior of puzzle component 12 to a level of the substantially planar face and are spaced apart therefrom. As can be seen in the sectional view of FIG. 8, projections 16 and recesses 18 extend from a common interior location of puzzle component 12. Only recesses 18 are disposed on minor sides of each puzzle component 12, though the arrangement of projections 16 and recesses 18 may be varied so that the major and minor sides include different numbers and combinations of projections 16 and recesses 18. The arrangement of projections 16 and recesses 18 on each side is opposite to the opposing side. In this regard, where there is a projection 16 on one side, on the opposite side there is a recess, and vice versa. The result is that by placing two identical puzzle components side by side will allow them to be brought into interlocking engagement with each other.

In other embodiments, a single projection 16, or more than two projections, and/or a single recess, and/or more than two recesses may be provided on either major side of the puzzle component 12. Also, one or more projections and/or one or more recesses may be provided on the minor sides.

In one form the projections are configured for a slight interference fit so as to be retained in a corresponding recess via friction. In the forms illustrated in FIGS. 8 and 9, the projections 16 take a generally hollow cylindrical form with an outward radial bulge 20 near a distal end. The recesses 18 are similarly of a generally hollow cylindrical form with an inward radial bulge 22 formed near a distal end. Bulges 20, 22 are configured to provide a snap-fit or snap-lock interlocking feature that undergoes tension while bringing the two parts together but which may be released once engaged so that neither part is under permanent strain to retain the puzzle components 12 together. To remove interlocked puzzle components 12 from each other, the interlocking features again undergo tension while separating the parts but this tension is released once separated.

It will be appreciated that the interlocking feature of FIGS. 7 to 10 may be varied. In other examples, only the projection 16 or the recess 18 may be snap-fitting in nature, i.e. being generally cylindrical and provided with a bulge.

Figure 14:
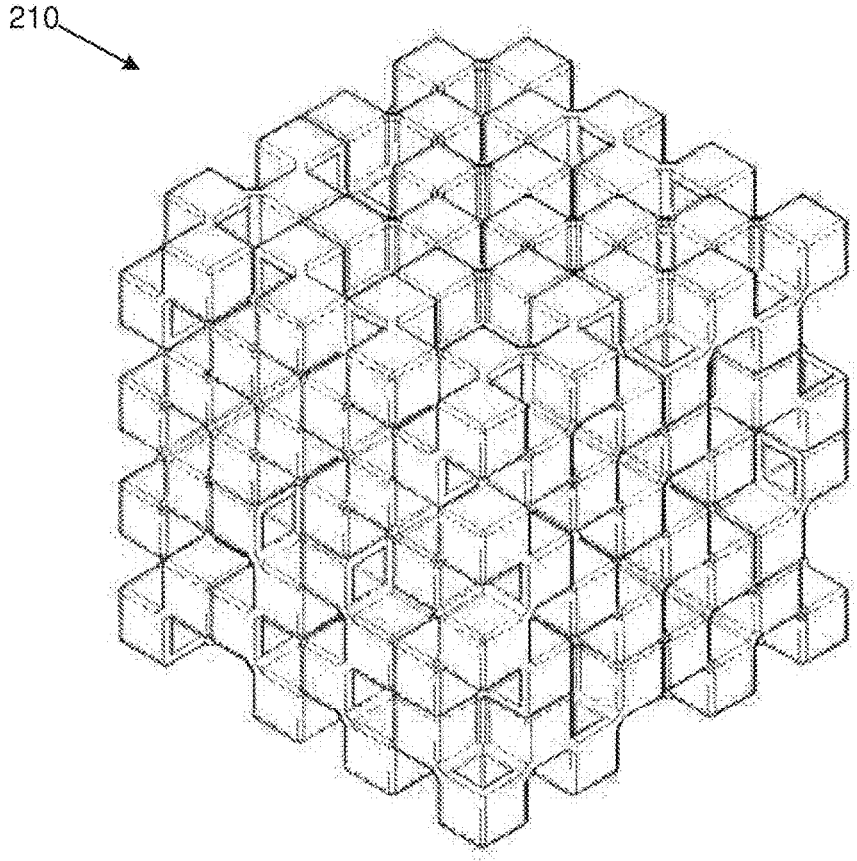
FIG. 14 is a 3D orthographic view of a logic puzzle of another embodiment of the invention.
Figure 15:
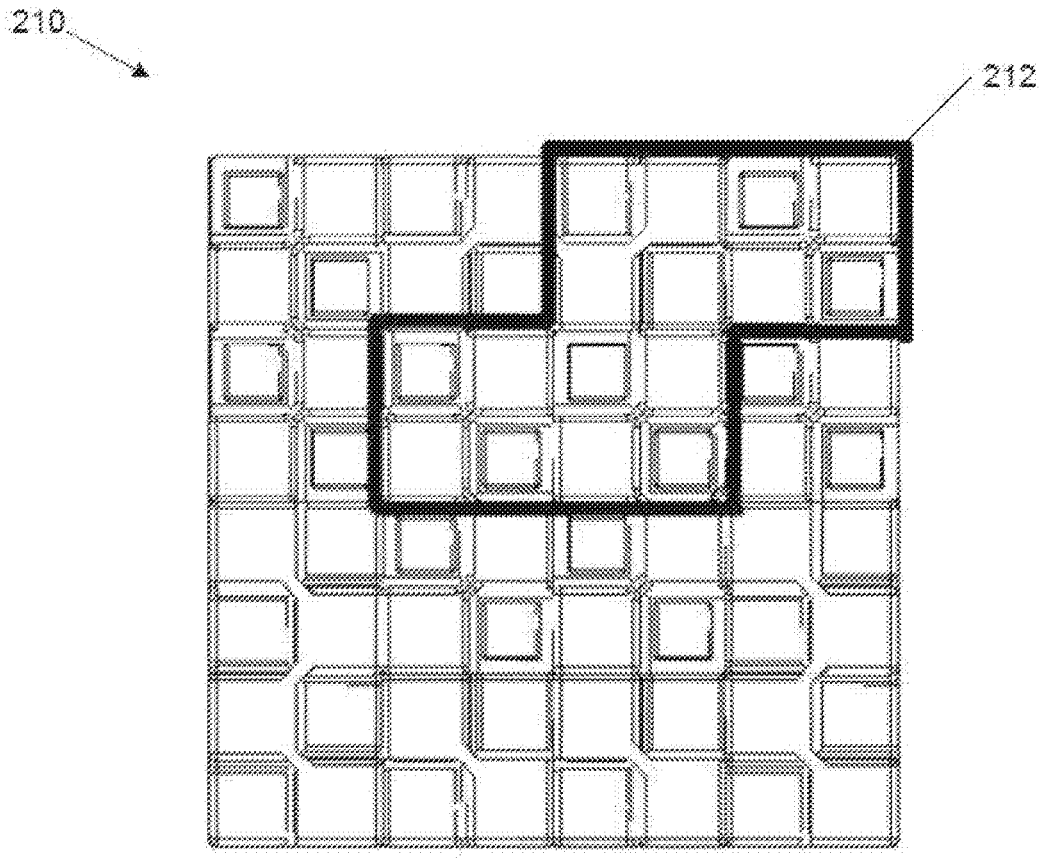
FIG. 15 is a side view of the puzzle of FIG. 14.
Figure 16:
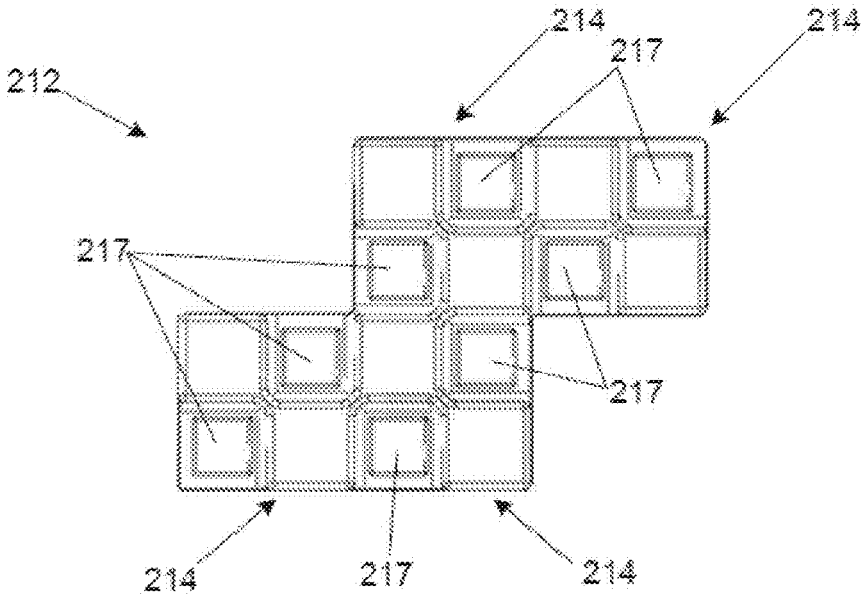
FIG. 16 is a side view of a puzzle component for use in the puzzle of FIG. 14.
Figure 17:
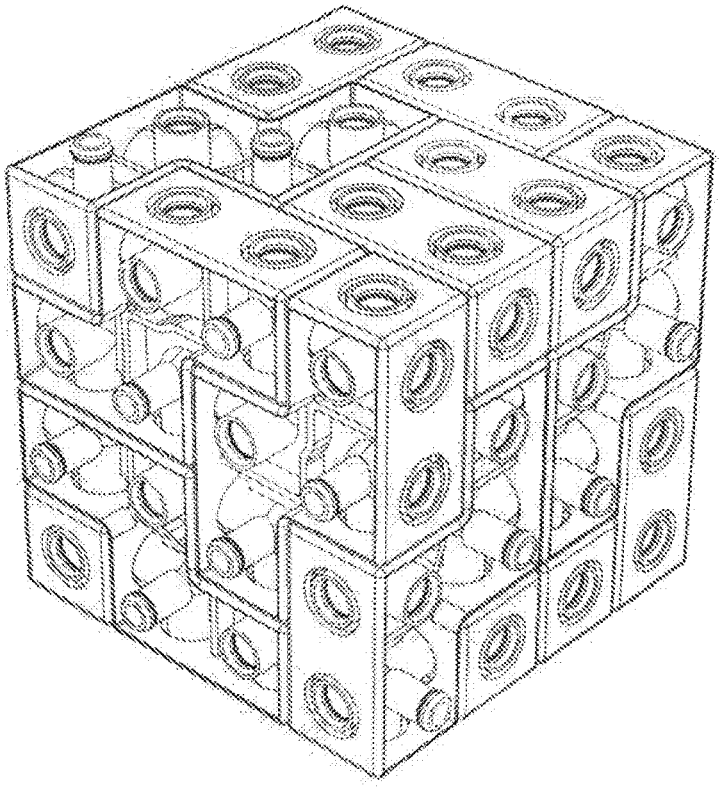
FIG. 17 is a perspective view of a logic puzzle of one embodiment of the invention.
Figure 18:
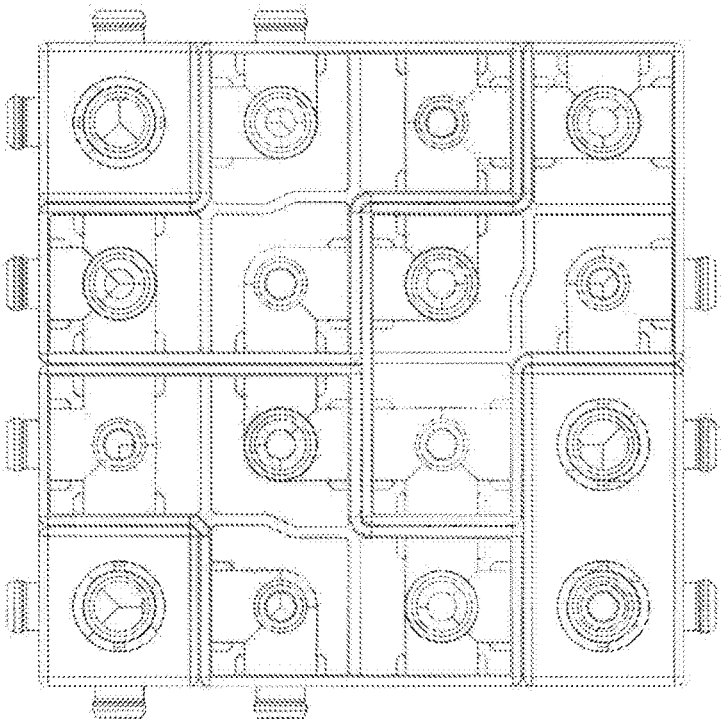
FIG. 18 is a front view of the logic puzzle of FIG. 17.
Figure 19:
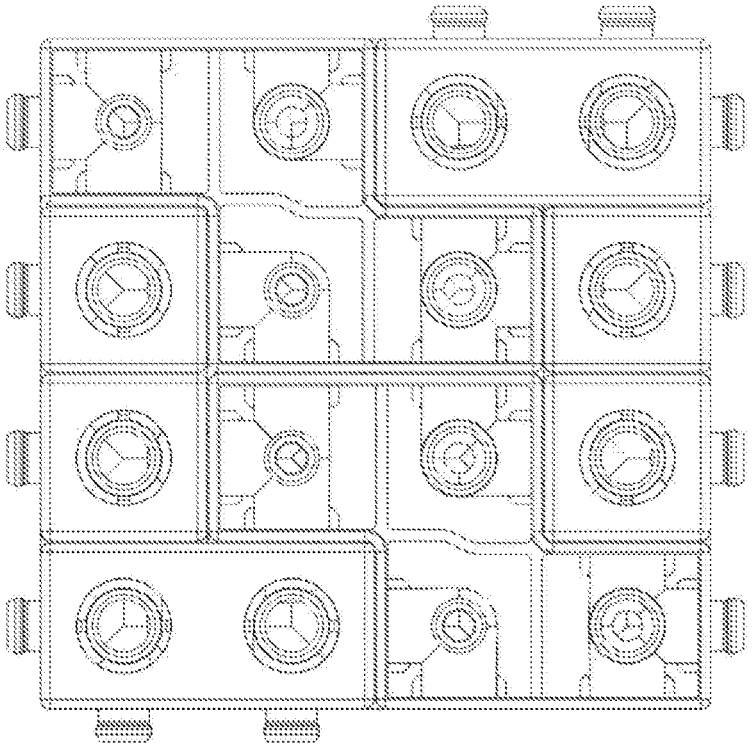
FIG. 19 is a left view of the logic puzzle of FIG. 17.
Figure 20:
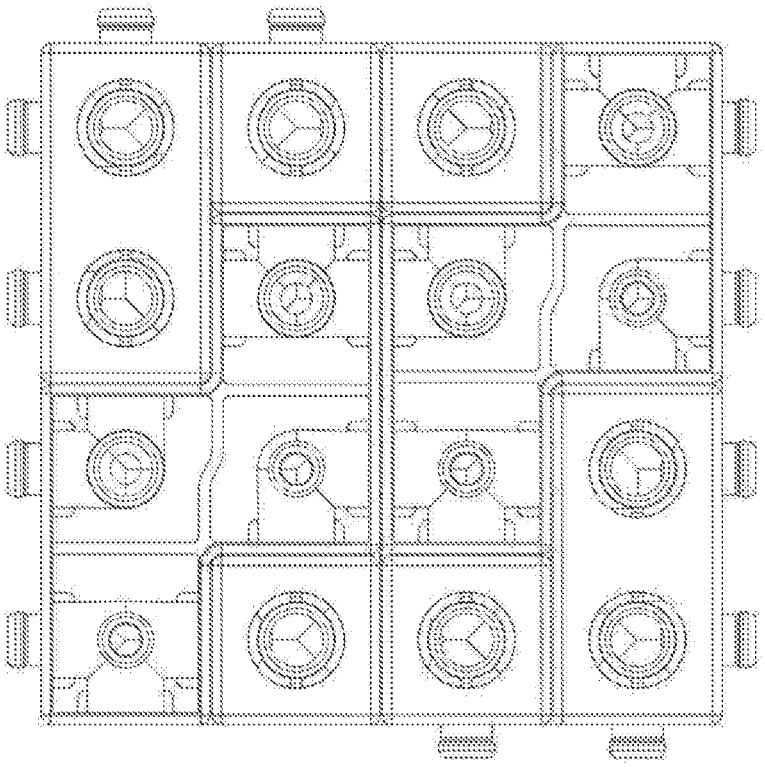
FIG. 20 is a right view of the logic puzzle of FIG. 17.
Figure 21:
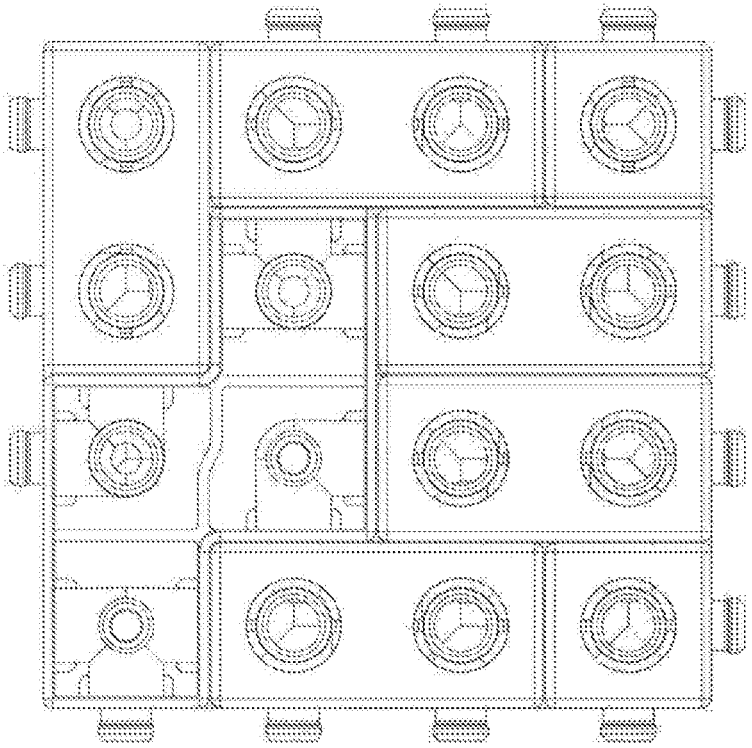
FIG. 21 is a top view of the logic puzzle of FIG. 17.
Figure 22:
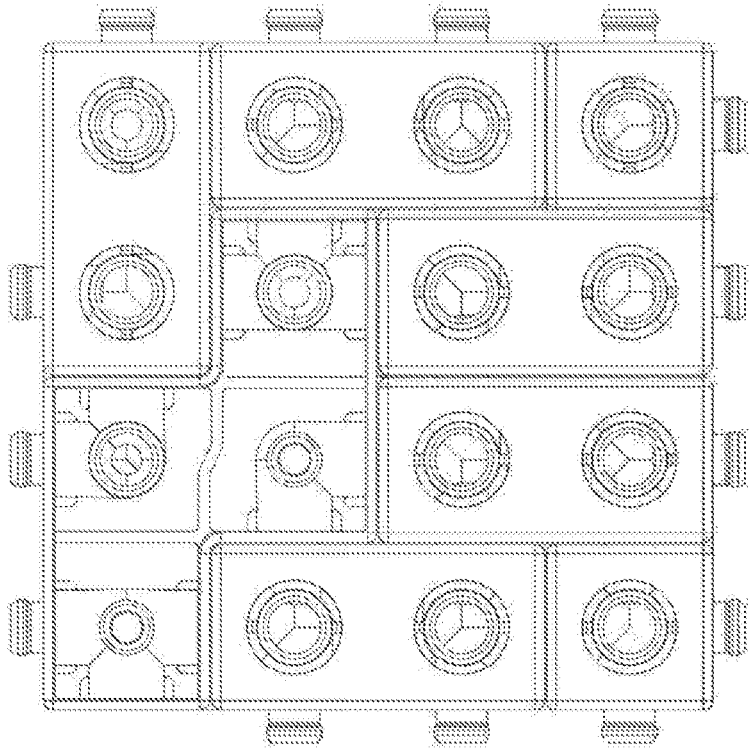
FIG. 22 is a bottom view of the logic puzzle of FIG. 17.
Figure 23:
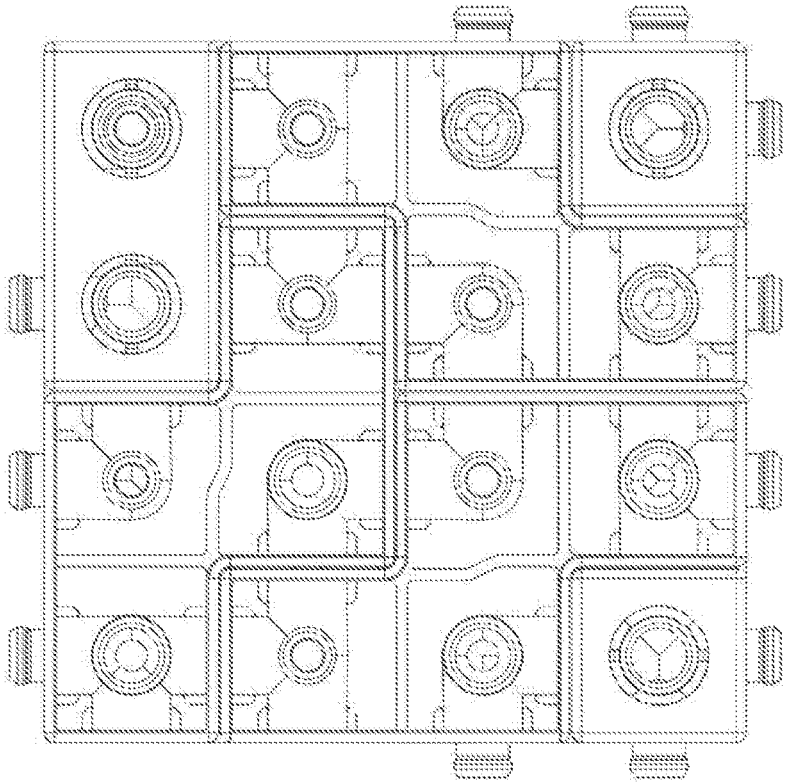
FIG. 23 is a rear view of the logic puzzle of FIG. 17.
Figure 24:
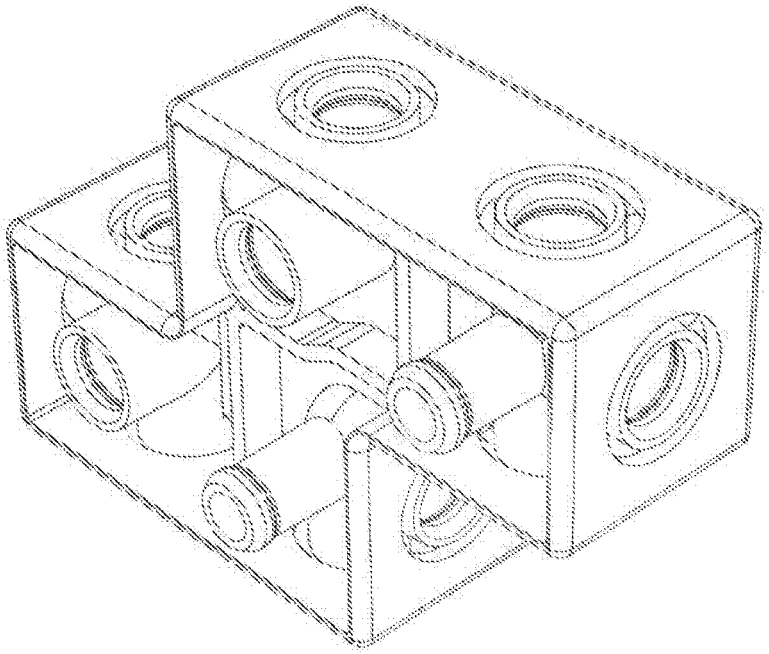
FIG. 24 is a perspective view of a puzzle component for use in the logic puzzle of FIG. 17.
Figure 25:
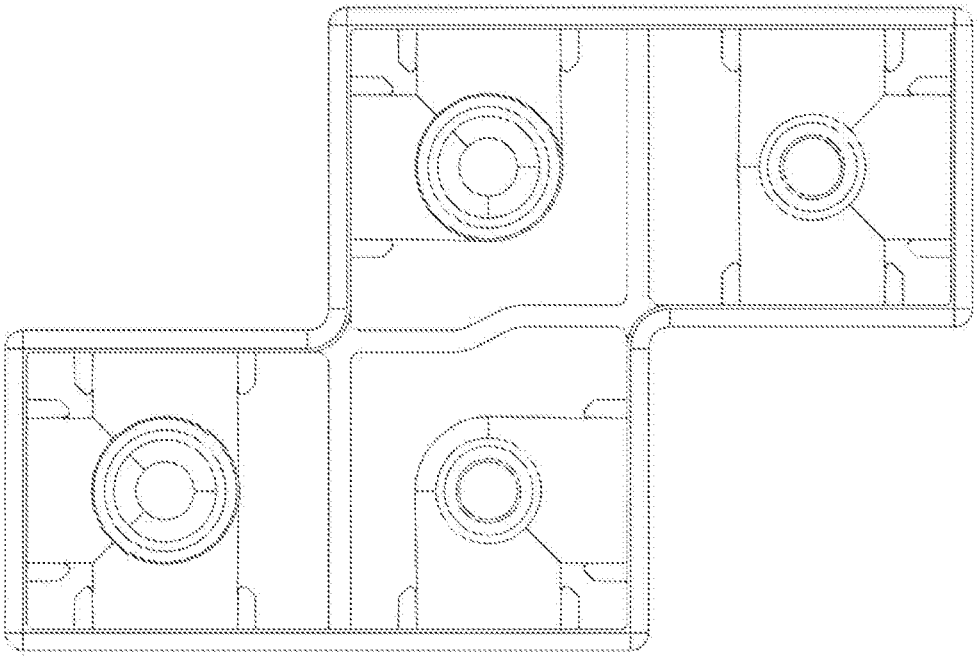
FIG. 25 is a front view of the puzzle component of FIG. 24.
Figure 26:
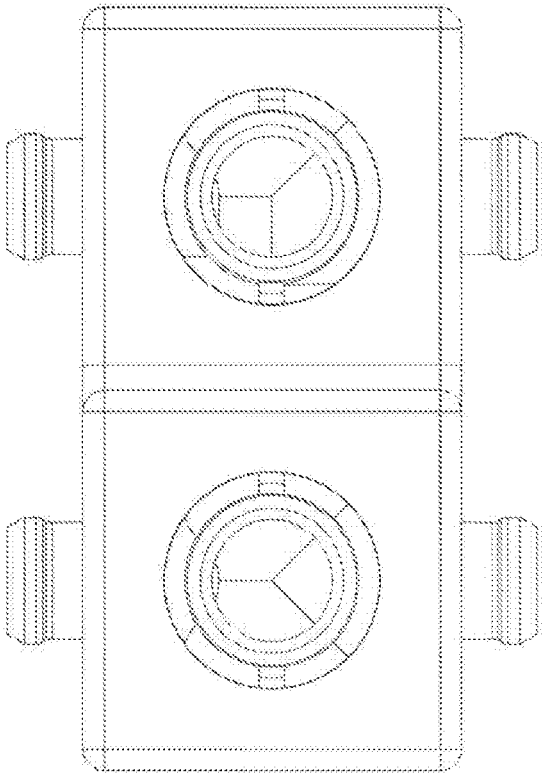
FIG. 26 is a left view of the puzzle component of FIG. 24.
Figure 27:
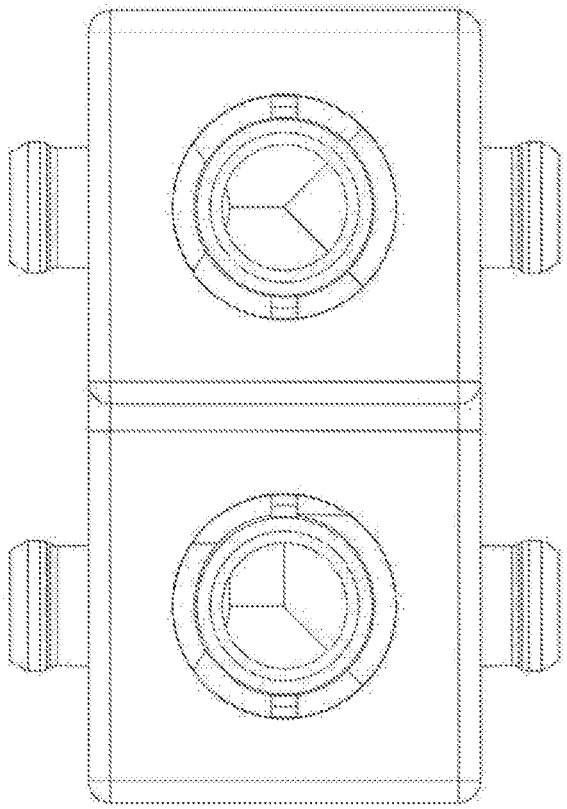
FIG. 27 is a right view of the puzzle component of FIG. 24.
Figure 28:
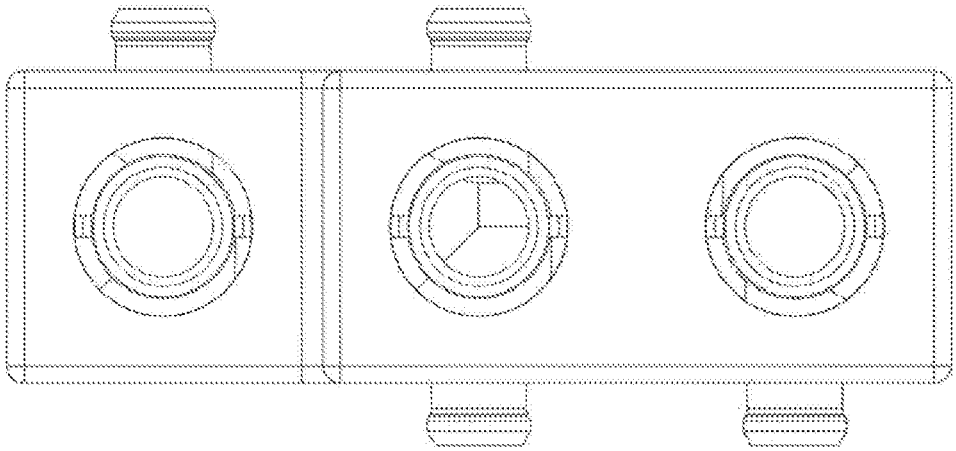
FIG. 28 is a top view of the puzzle component of FIG. 24.
Figure 29:
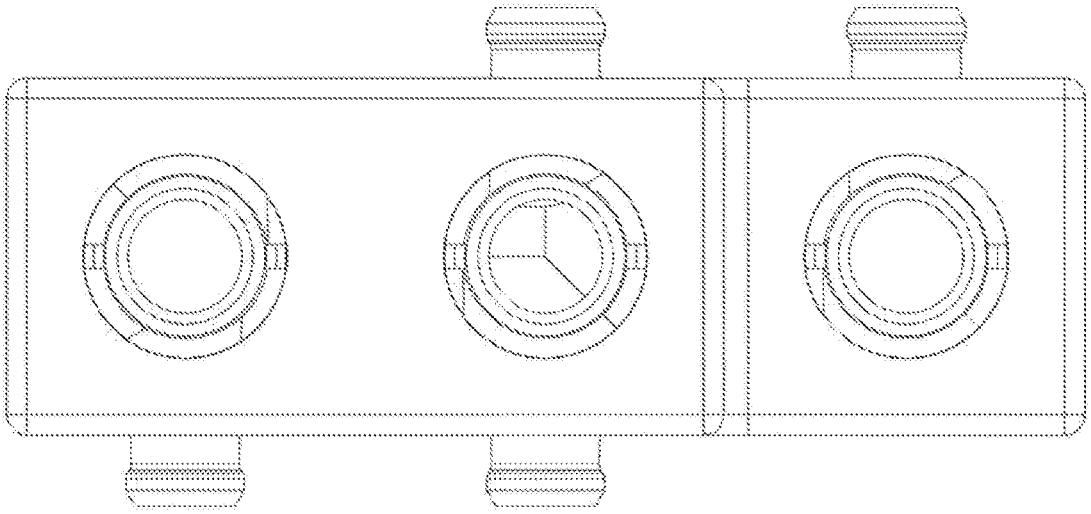
FIG. 29 is a bottom view of the puzzle component of FIG. 24.
Figure 30:
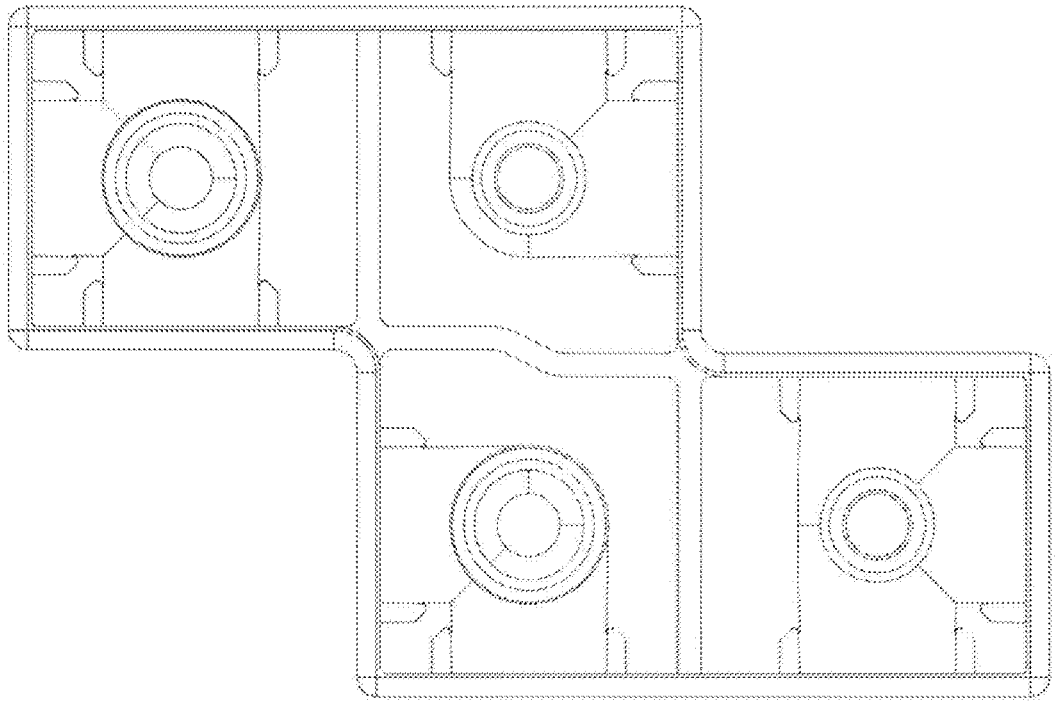
FIG. 30 is a rear view of the puzzle component of FIG. 24.
Figure 31:
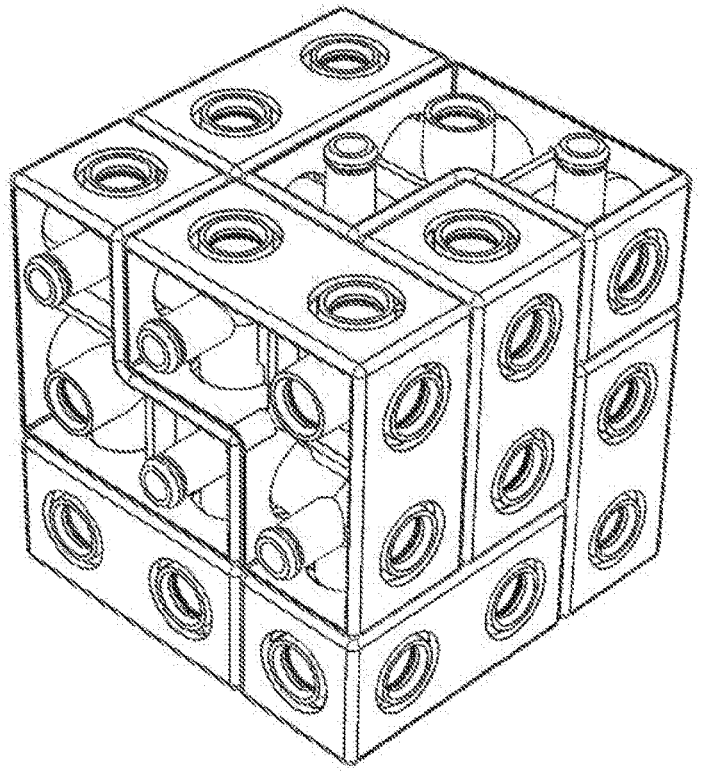
FIG. 31 is a perspective view of a logic puzzle of another embodiment of the invention.
Figure 32:
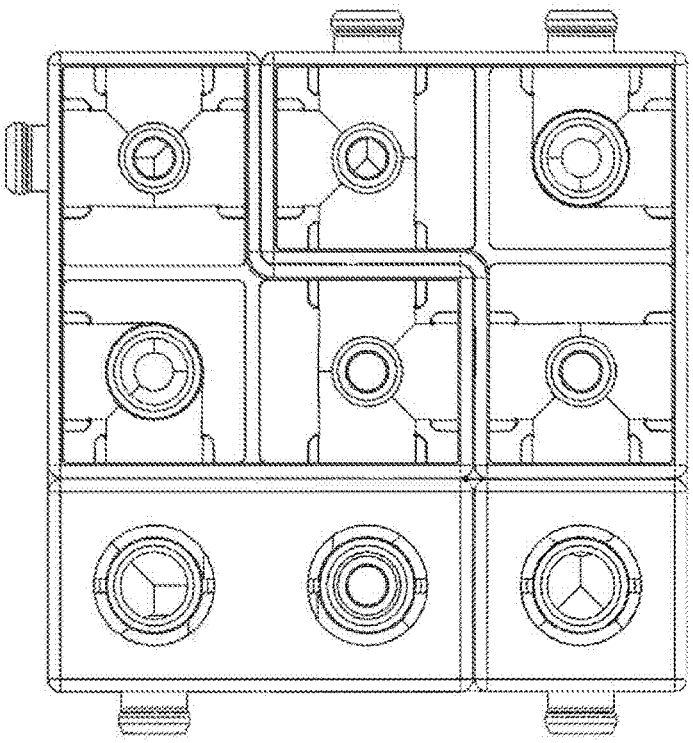
FIG. 32 is a front view of the logic puzzle of FIG. 31.
Figure 33:
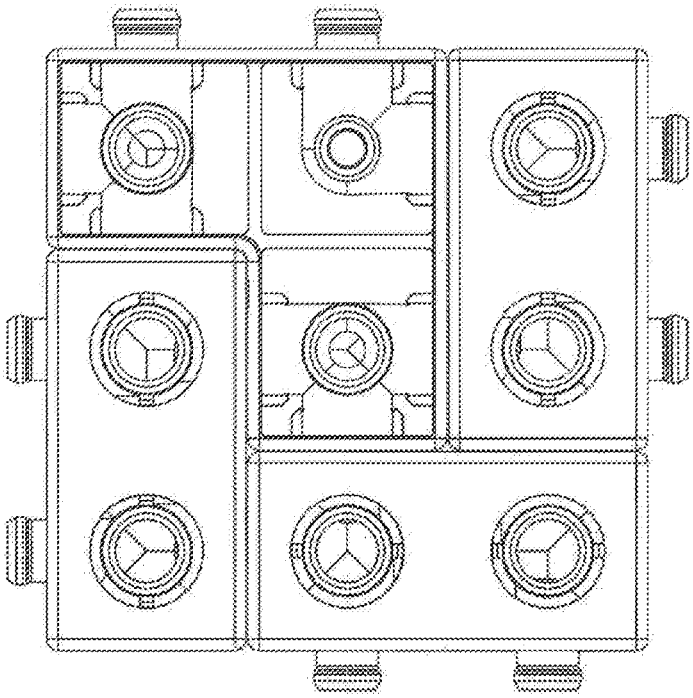
FIG. 33 is a left view of the logic puzzle of FIG. 31.
Figure 34:
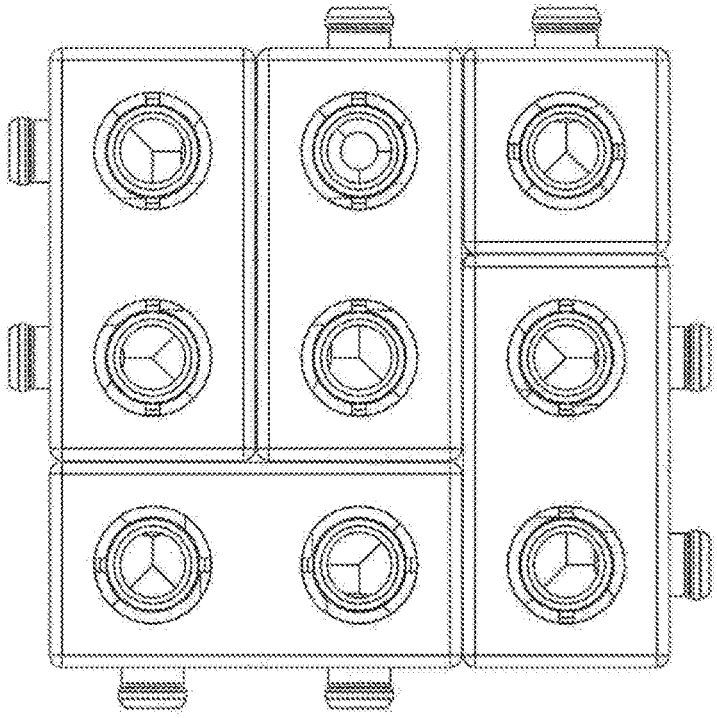
FIG. 34 is a right view of the logic puzzle of FIG. 31.
Figure 35:
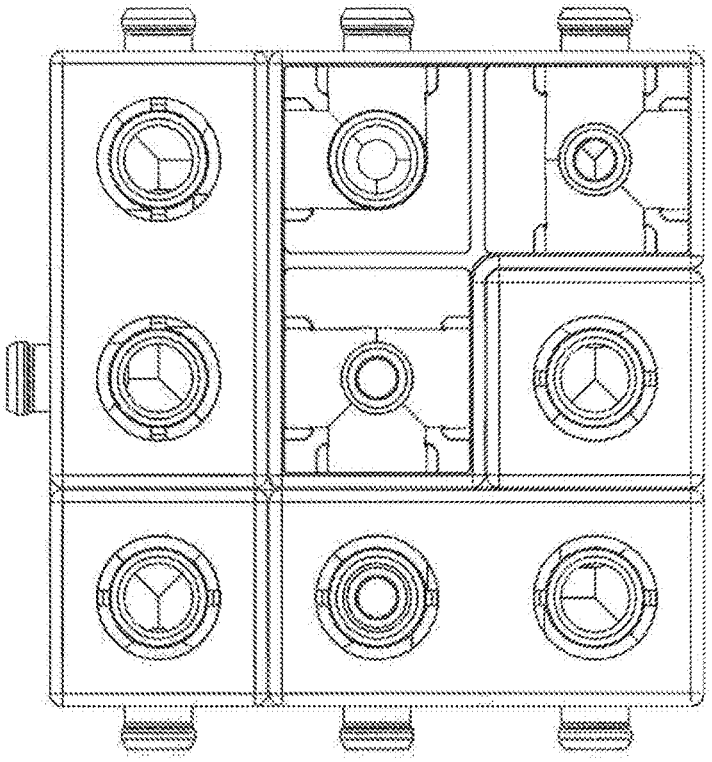
FIG. 35 is a top view of the logic puzzle of FIG. 31.
Figure 36:
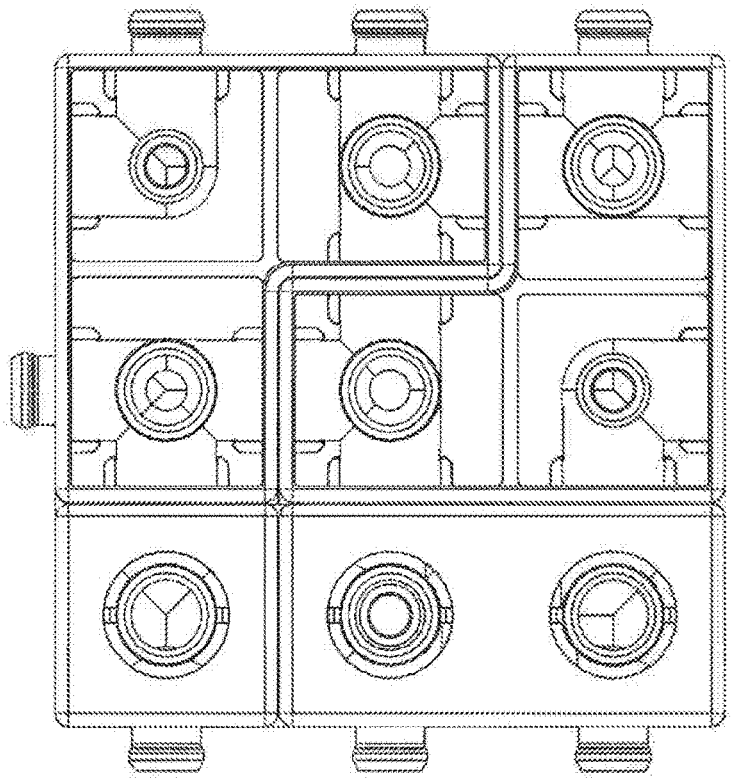
FIG. 36 is a bottom view of the logic puzzle of FIG. 31.
Figure 37:
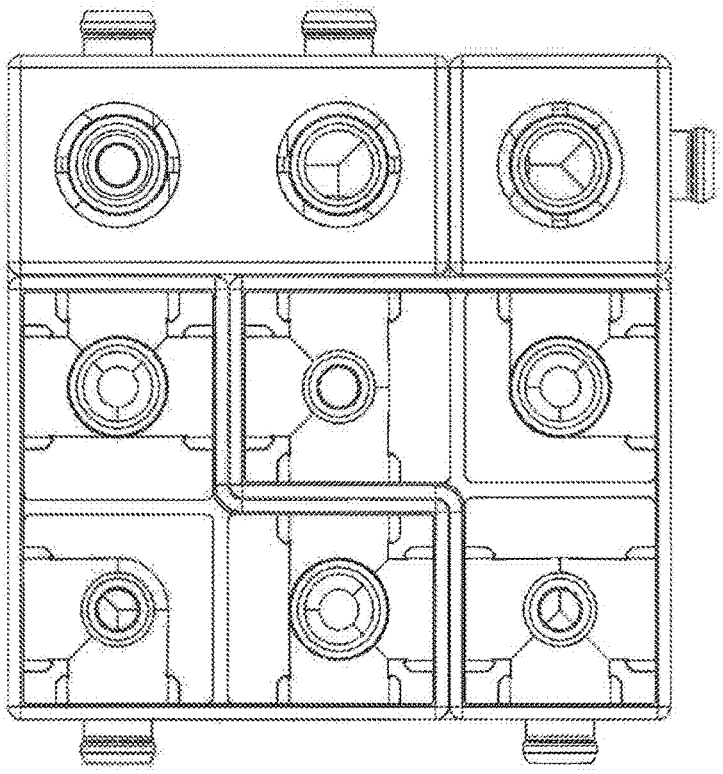
FIG. 37 is a rear view of the logic puzzle of FIG. 31.
Figure 38:
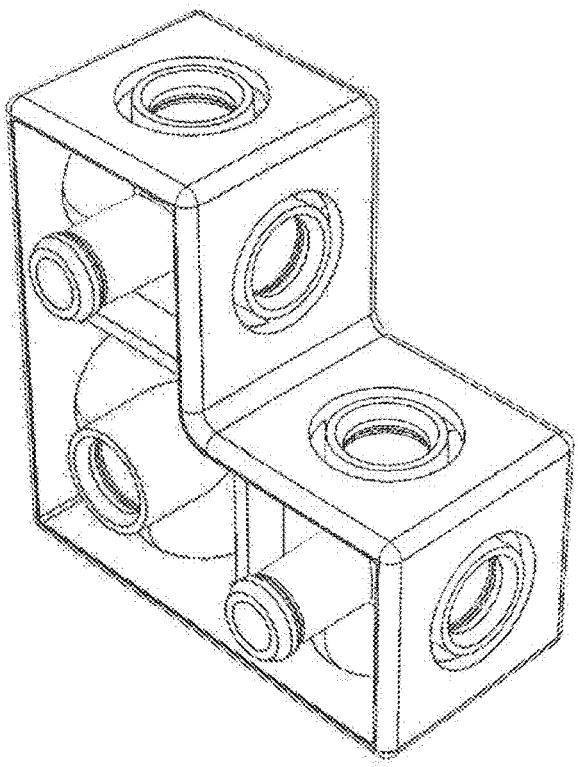
FIG. 38 is a perspective view of a puzzle component for use in the logic puzzle of FIG. 31.
Figure 39:
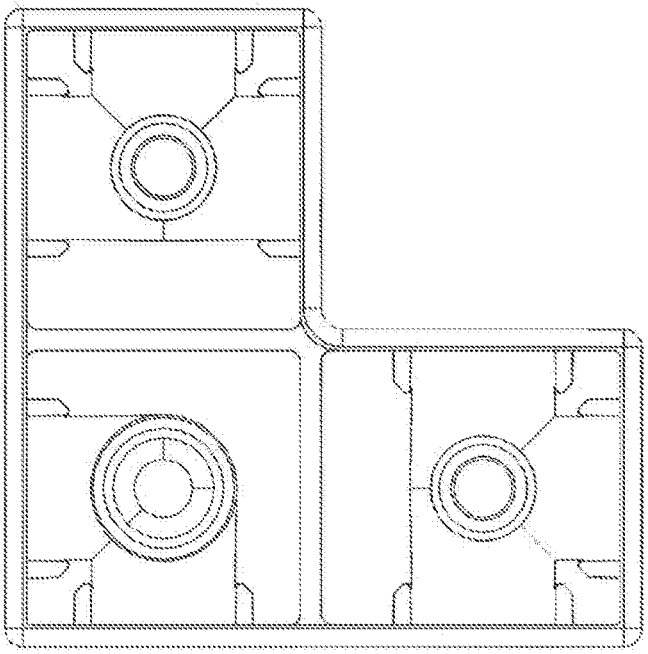
FIG. 39 is a front view of the puzzle component of FIG. 38.
Figure 40:
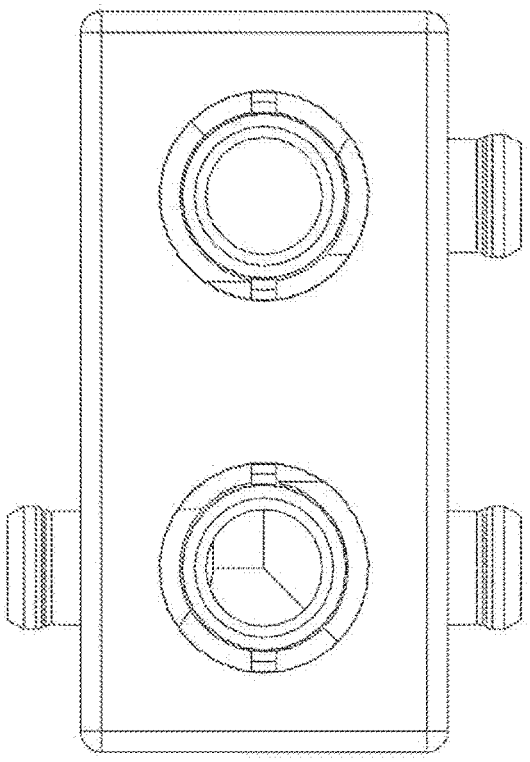
FIG. 40 is a left view of the puzzle component of FIG. 38.
Figure 41:
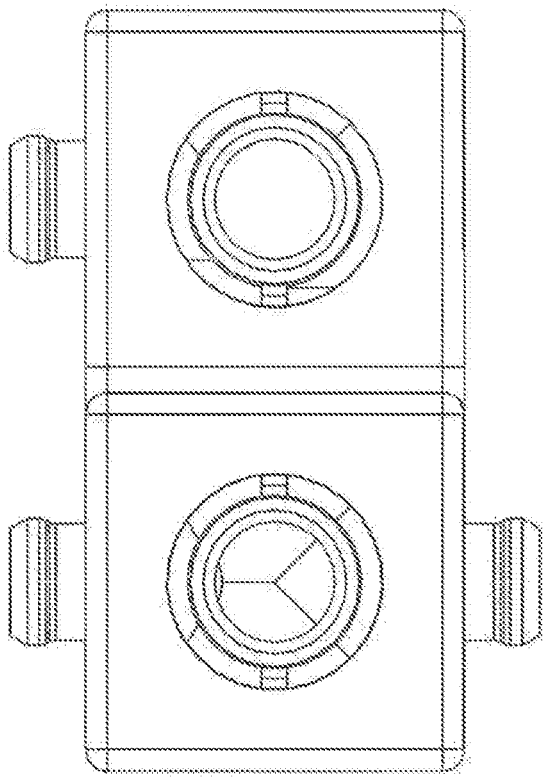
FIG. 41 is a right view of the puzzle component of FIG. 38.
Figure 42:
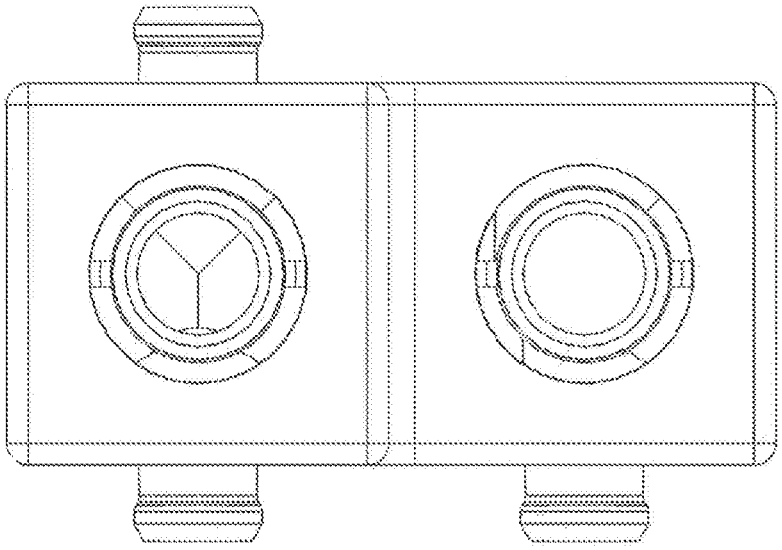
FIG. 42 is a top view of the puzzle component of FIG. 38.
Figure 43:
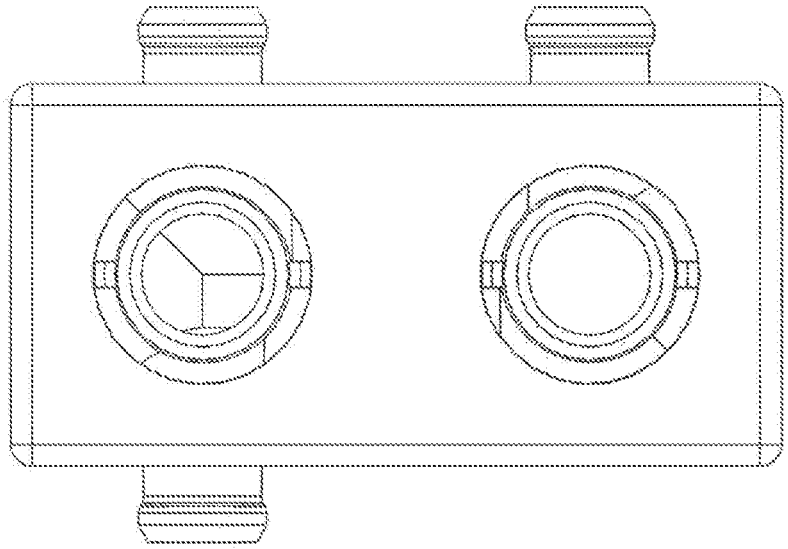
FIG. 43 is a bottom view of the puzzle component of FIG. 38.
Figure 44:
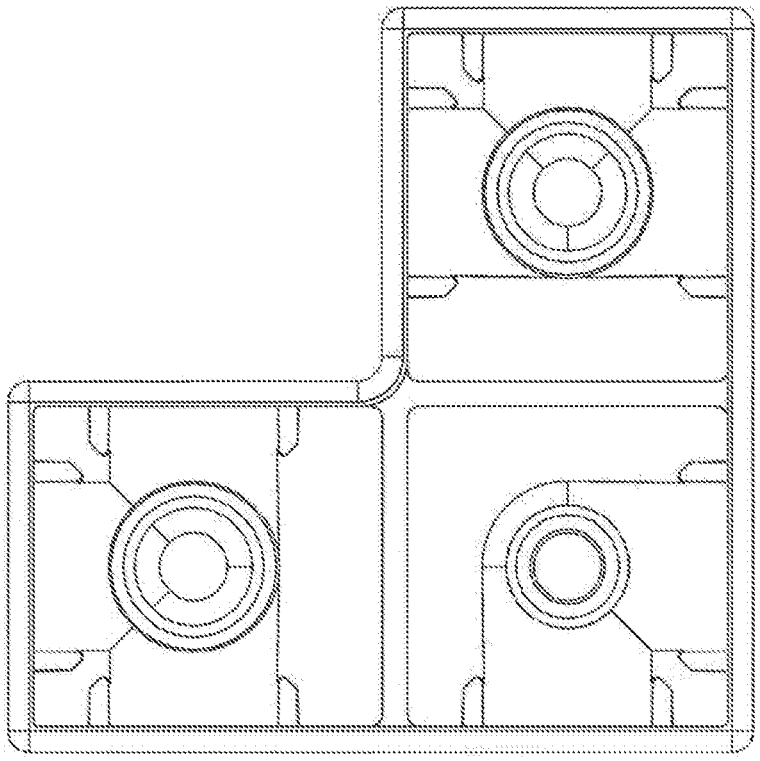
FIG. 44 is a rear view of the puzzle component of FIG. 38.

FIGS. 14 to 16 illustrate another embodiment of the invention which is also a 4× puzzle and configures generally similar to puzzle 10. In this puzzle 210, the puzzle components 212 (one of which is shown highlighted by a thicker outline in FIG. 15) are also configured for interengagement but not interlocking engagement with each other.

As can be seen more clearly in FIG. 16, the puzzle component 212 is again formed of four elements (214), however, the face of each element has two recesses 217, thereby dividing the face of each element into four sections to provide a more confusing visual appearance to increase the challenge to a user.

The puzzles of the illustrated embodiments take a final geometric shape of a cube, though it will be appreciated that other geometric shapes are possible, some of which will be regular and others not. For example, the shape may be selected from a group including, but not limited to, a cube, a parallelepiped, a sphere, a pyramid, a prism, a cone, a cylinder and a torus. It will be appreciated that the shape described by the final form of the puzzle may be the general outline of the assembled puzzle components and not necessarily a smooth surface since, for example, rectangular components cannot be used to form a smooth spherical surface.

The described embodiments are preferably formed of a thermoplastic material using injection moulding processes. By configuring the puzzle so that the puzzle components can be identical, the puzzle components can be manufactured in volume, thereby greatly reducing the cost of manufacturing the puzzle. Of course, the described embodiments can also be formed from materials, such as wood, polymers and/or metals.

In use, a puzzle of the type described herein is completed by the steps of reorientating each puzzle component by rotating it about its axes, and bringing the puzzle components into interengagement with other adjacent components to form a three-dimensional geometric shape. Typically, this will include trial and error to arrive at the desired predetermined form.

Although a physical implementation of the invention has been described, it will be appreciated that it may also be implemented in a digital form via digital embodiments.

Digital embodiments may include videogames, a webpage, a computer game or a mobile phone app. It will be appreciated that in such embodiments, the method of completing the puzzle may be virtually the same.

Furthermore, the described puzzle components, which may be made of 3, 4, 5 or more individual elements, may also be used to build a three-dimensional toy structure such as a building or castle for example, thereby increasing the usefulness and appeal of the puzzle to users.

It is of course envisaged that details of the described and depicted puzzle components may vary for ease of mass manufacture, for example to accommodate injection-molding tool design constraints.

The embodiments have been described by way of example only and modifications are possible within the scope of the invention disclosed.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as, an acknowledgement or admission or any form of suggestion that that prior publication (or information derived from it) or known matter forms part of the common general knowledge in the field of 10 endeavour to which this specification relates.

The invention claimed is:

1. A three-dimensional logic puzzle, comprising a plurality of identically shaped puzzle components of an irregular form, the puzzle components being configured for interengaged assembly into the form of a predetermined three-dimensional geometric shape, wherein at least one side of each puzzle component comprises a substantially planar face, each puzzle component is formed with at least one projection and/or two or more correspondingly shaped recesses, each of the two or more recesses is defined by a wall that extends from an interior of the puzzle component to a level of the substantially planar face and is spaced apart therefrom, each of the two or more recesses extends from a common interior location of each puzzle component, and the at least one projection and at least one of the two or more recesses are formed with snap-fit interlocking features such that the at least one projection of each puzzle component is configured for interlocking engagement with a corresponding recess of the two or more recesses of an adjacent puzzle component.

2. A puzzle according to claim 1, wherein the puzzle components are each formed of a plurality of individual elements.

3. A puzzle according to claim 2, wherein the individual elements are cuboid in shape.

4. A puzzle according to claim 2, wherein the individual elements are formed of three planar bodies sharing a common centre point and arranged to be mutually orthogonal to one another.

5. A puzzle according to claim 2, wherein the puzzle components are formed from four individual elements arranged in a generally "S" shaped configuration.

6. A puzzle according to claim 2, wherein the puzzle components are formed from three individual elements arranged in a generally "L" shaped configuration.

7. A puzzle according to claim 1, wherein the predetermined geometric shape is a cube in which the length of sides of the cube is equal to the size of each element multiplied by the number of elements in each puzzle component.

8. A puzzle according to claim 1, wherein each puzzle component comprises opposing major sides, a major side being a planar side of the puzzle component with a maximum area relative to one or more other sides of the puzzle component, and the arrangement of the at least one projection and/or at least one of the two or more recesses on each opposing major side is complementary on an opposing side.

9. A puzzle according to claim 8, wherein each puzzle component is formed with two projections and two recesses on opposing major sides of each puzzle component, and the arrangement of projections and recesses on each opposing major side is opposite to a respective opposing major side.

10. A puzzle according to claim 8, wherein recesses are disposed on sides other than the opposing major sides of each puzzle component.

11. A puzzle according to claim 1, wherein the at least one projection is generally cylindrical.

12. A puzzle according to claim 1, wherein the at least one projection has a cross section in the form of a parallelogram.

13. A puzzle according to claim 1, wherein the predetermined geometric shape is a regular geometric shape.

14. A puzzle according to claim 1, wherein the predetermined geometric shape is selected from the group consisting of: a cube, a parallelepiped, a pyramid, a sphere, a prism, a cone, a cylinder, and a torus.

15. A puzzle component for use in a three-dimensional logic puzzle according to claim 1, the puzzle component being of an irregular form.

16. A puzzle component according to claim 15, constructed of a plurality of like individual elements.

17. A method for a three-dimensional logic puzzle, the method comprising:

forming multiple identically shaped puzzle components of an irregular form;

forming each puzzle component to comprise a substantially planar face;

forming each puzzle component to have at least one projection and/or two or more correspondingly shaped recesses;

forming the two or more recesses to have a wall that extends from an interior of the puzzle component to a level of the substantially planar face and is spaced apart therefrom;

forming each of the two or more recesses to extend from a common interior location of each puzzle component; and forming the at least one projection and at least one of the two or more recesses to have snap-fit interlocking features such that the at least one projection of each puzzle component is configured for interlocking engagement with a corresponding recess of the two or more recesses of an adjacent puzzle component when the puzzle components are assembled, wherein assembling the puzzle comprises the steps of:

reorientating each of the multiple puzzle components by rotating it about its axes, and bringing each of the multiple puzzle components into interlocking interengagement with one or more other puzzle components of the multiple puzzle components to form a three-dimensional geometric shape.

18. A method of assembling a three-dimensional logic puzzle according to claim 17, implemented by computer software executed on a fixed, portable, and/or hand-held computing device.

19. A puzzle according to claim 1, wherein the at least one projection extends outwardly from the common interior location.

20. A puzzle according to claim 1, wherein the at least one side of each puzzle component that comprises the substantially planar face is a first side, each puzzle component further includes a second side that comprises a substantially hollow region without a planar face, and at least one projection and/or at least one of the two or more recesses defined by a wall occupies the otherwise substantially hollow region and is spaced apart from adjacent substantially planar faces of the puzzle component.

* * * * *